United States Patent [19]

Martin

[11] 4,269,410

[45] May 26, 1981

[54] TENNIS TRAINING DEVICE

[76] Inventor: James H. Martin, 2120 S. Glenbrook, #16P, Garland, Tex. 75041

[21] Appl. No.: 69,178

[22] Filed: Aug. 24, 1979

[51] Int. Cl.[3] ..... A63B 61/00

[52] U.S. Cl. ..... 273/29 A

[58] Field of Search ..... 273/29 A, 26 E, 413

[56] References Cited

U.S. PATENT DOCUMENTS

| | | | |
|---|---|---|---|
| 2,247,072 | 6/1941 | Stow | 273/29 A |
| 2,272,765 | 2/1942 | Beeson et al. | 273/29 A |
| 2,305,187 | 12/1942 | Neiden | 273/29 A |
| 2,772,882 | 12/1956 | Anson | 273/26 E |
| 3,397,885 | 8/1968 | Nash, Jr. | 273/26 E |
| 3,618,585 | 11/1971 | Allison | 124/20 |
| 3,866,912 | 2/1975 | Scainetti | 273/29 A |
| 3,893,669 | 7/1975 | Myers | 273/26 E |
| 3,940,132 | 2/1976 | Lopatti et al. | 273/29 A |
| 3,994,494 | 11/1976 | Kelley | 273/26 E |

*Primary Examiner*—Richard C. Pinkham
*Assistant Examiner*—T. Brown
*Attorney, Agent, or Firm*—Richards, Harris & Medlock

[57] ABSTRACT

The specification discloses a training device (10) for the game of tennis which is adapted to be mounted on a stand (12). The training device (10) comprises a frame (22) which is supported on the stand (12) with a top block (30) and a line and pulley arrangement. A fixed arm (40) and a line-actuated pivotal arm (42) are secured to the frame (22). A flexible line (58) extends downwardly from the pivotal arm (42) and a tennis ball is releasably connected to the string for suspension thereby to facilitate practice of various strokes.

4 Claims, 5 Drawing Figures

FIG. 1
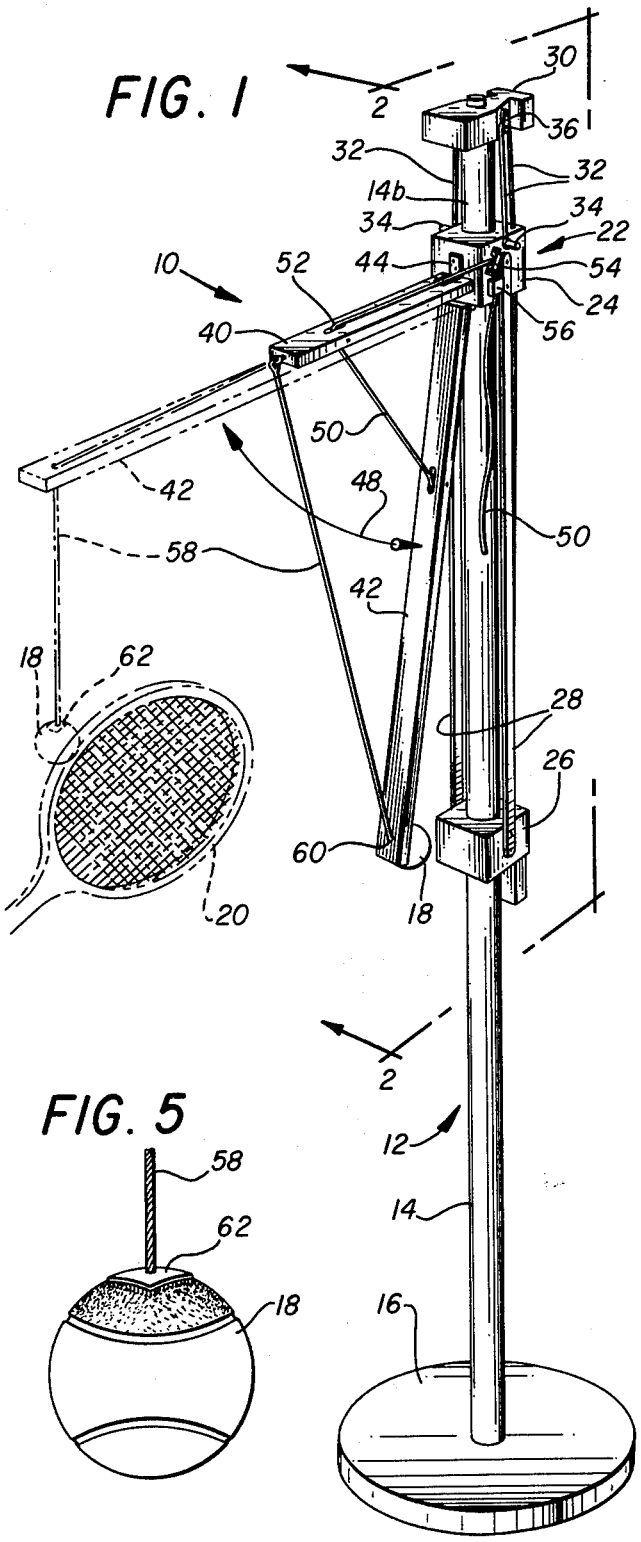
FIG. 3
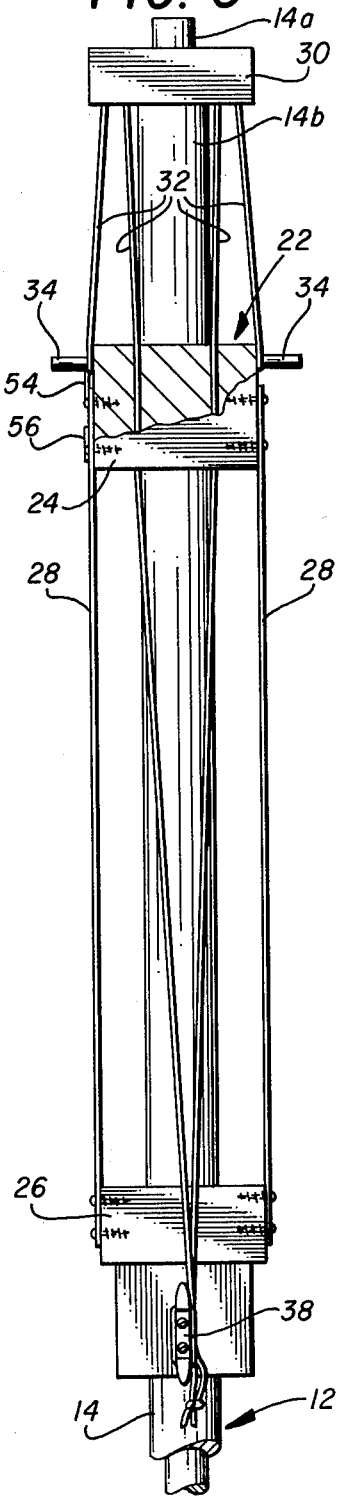
FIG. 5

TENNIS TRAINING DEVICE

TECHNICAL FIELD

The present invention relates in general to a training apparatus, and more particularly to a training device for the game of tennis.

BACKGROUND ART

The game of tennis involves serving, returning and volleying the ball with a variety of strokes. The service is an especially important aspect of the game because the serving player has a slight advantage over the receiving player. That player having the strongest serve often wins many points during a game.

While the service is one of the more important aspects of tennis, it is also one of the more difficult aspects of the game to learn and improve. The service requires coordination between tossing and ball overhead with one hand and striking the ball with a racket held in the other hand such that the ball is propelled over the net and into the service court of the opposing player. Ideally, the toss and stroke should be coordinated such that the apex of the toss corresponds to the position of the racket during the overhead stroke in order to achieve maximum power and angle of declination over the net. A good serve thus requires body coordination, control, power and timing.

Although the service can be practiced without the aid of a training device, this does not permit practice of the service stroke independent of the toss and vice versa. Tennis training devices have been developed heretofore; however, these devices are either unsuitable for practicing the service stroke or suffer from other difficulties. In some devices of the prior art, for example, the balls are tethered or constrained to stands such that poor indications are given of the flight paths of the balls. Other devices lob balls over the net at the player and are therefore more suitable for practicing returns rather than serves. The instructional device shown in U.S. Pat. No. 3,940,132 releasably suspends balls by means of a suction system which requires external power and is therefore relatively expensive and not readily portable. A need has thus arisen for an improved tennis training device which is particularly suited for developing the service stroke, but which can be used for practicing other strokes as well.

DISCLOSURE OF INVENTION

The present invention comprises a training device which overcomes the foregoing and other difficulties associated with the prior art. In accordance with the invention, there is provided a training aid for the game of tennis which is particularly adapted for practicing the service stroke, but which can be used to practice other strokes as well. The training device herein is inexpensive to fabricate, manually operated, and easily adjustable in accordance with the height of the particular user. Use of the invention enables a player to practice the service stroke independently of the toss.

In accordance with more specific aspects of the invention, there is provided a training apparatus adapted to be adjustably supported on an upstanding post, mast or the like. The training apparatus comprises a frame which is slidable along the post or mast and adjustably supported thereon with a line and pulley arrangement in the preferred embodiment of the invention. Fixed and pivotal arms are secured to the frame, and a flexible line attached at one end to the fixed arm extends through an opening near the distal end of the pivotal arm. A connector, such as a piece of hook and loop fabric, is provided at the end of the flexible line for releasable engagement with a tennis ball. When the pivotal arm is in the raised position, the ball is suspended at the proper height for stroking practice. After the ball is stroked and disconnected from the flexible line, the pivotal arm can be lowered to facilitate attachment of another ball on the line.

BRIEF DESCRIPTION OF DRAWINGS

A more complete understanding of the invention can be had by referring to the following Detailed Description in conjunction with the accompanying Drawings, wherein:

FIG. 1 is a perspective view of a tennis training device incorporating the invention;

FIG. 3 is a side view of the invention;

FIG. 5 is a detail view illustrating connection of a ball to the suspension line.

DETAILED DESCRIPTION

Figure 2:
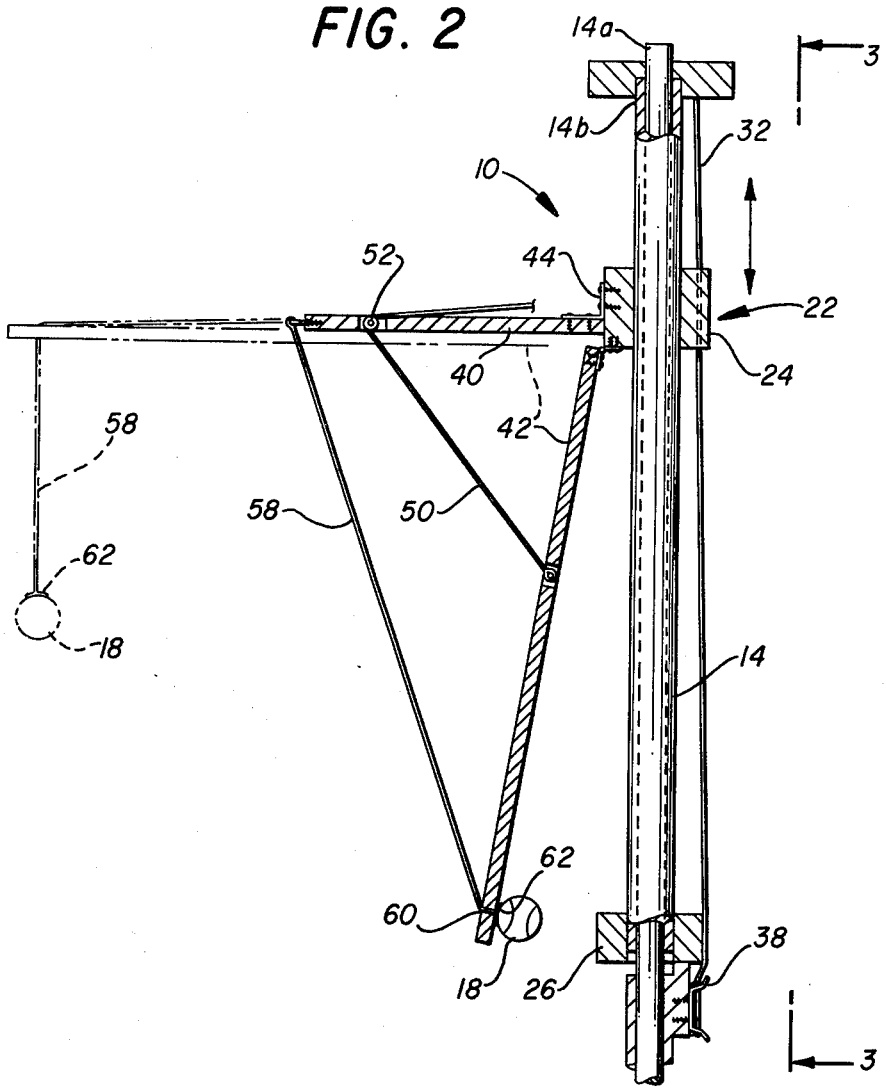
FIG. 2 is a sectional view taken along lines 2—2 of FIG. 1 in the direction of the arrows.
Figure 4:
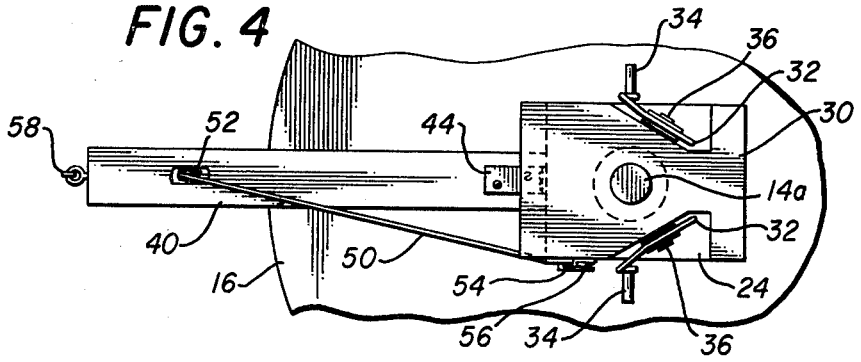
FIG. 4 is a top view of the invention.

Referring now to the Drawings, wherein like reference numerals designate like or corresponding parts throughout the several views, and particularly referring to FIG. 1, there is shown a tennis training device 10 incorporating the invention. Device 10 is portable and manually operated, and is particularly adapted for practice of tennis strokes. Tennis balls can be suspended by device 10 at adjustable heights so that a player can concentrate on stroking the ball properly without the distractions of watching and attempting to hit a moving ball, tossing a ball overhead, or coordinating the toss and stroke. Since device 10 releasably suspends balls, control as well as power can be developed with the invention.

In the preferred embodiment, training device 10 is utilized with a portable stand 12. Stand 12 includes a vertical post or mast 14 of suitable height and a base 16. Mast 14 can be about 8–12 feet tall, for example. As will be more fully explained hereinafter, device 10 is adjustably supported on stand 12 so that a tennis ball 18 can be suspended at the desired height for stroking by a racket 20.

Although training device 10 is preferably used with a portable stand such as stand 12, it will be understood that the training device herein can be mounted on any suitable post or the like of adequate height. For example, training device 10 could be supported on a pole which is permanently anchored in the ground, if desired.

The constructional details of training device 10 are shown in FIGS. 1–4. Device 10 includes a frame 22 by which it is supported on stand 12. Frame 22 comprises a pair of blocks 24 and 26 interconnected by side bars 28, which are best shown in FIGS. 1 and 3. Blocks 24 and 26 are bored to slidably receive mast 14 of stand 12 therethrough. It will be thus understood that frame 22 is slidable with respect to stand 12.

Frame 22 of training device 10 is adjustably supported on stand 12 by means of a line and pulley arrangement. A top block 30 is positioned over the upper end of mast 14. A pair of lines 32, which are secured at one end to pegs 34 on block 24, extend around pulleys 36 on top block 30 and downwardly therefrom. The other ends of lines 32 are wrapped about a cleat 38 secured to mast 14 below frame 22. If desired, a pair of bores can be provided in block 24 as shown in FIGS. 2 and 3 for guiding lines 32. The position of device 10 on stand 12 can thus be changed simply by releasing and drawing in or letting out lines 32, and then reattaching the lines to cleat 38.

Although mast 14 is illustrated as comprising a core 14*a* surrounded by a sleeve 14*b* and with top block 30 receiving core 14*a* therethrough and resting on sleeve 14*b*, it should be apparent that the mast can comprise a one piece elongate member with a non-bored top block received thereover. This is the full equivalent of the structure disclosed herein and is considered to be within the scope of the invention.

Two arms 40 and 42 are mounted on frame 22. Arm 40 is rigidly secured to block 24 by conventional means, such as with a bracket 44 and screws, and extends laterally outward therefrom. Arm 42 is located beneath arm 40 and is pivotally secured to block 24 with a hinge 46. Arm 42 is thus mounted for pivotal movement between raised and lowered positions as indicated by arrows 48 in FIG. 1. A flexible cord 50, which is secured at one end to arm 42, extends around a roller 52 mounted in an opening provided in fixed arm 40. From roller 52, cord 50 extends through guide 54 and is secured by conventional clamping means, such as a jam cleat 56. Arm 42 can thus be raised or lowered by means of cord 50.

Referring to FIGS. 1, 2 and 5, a tennis ball 18 is suspended from the end of arm 42 by means of a fixed length of flexible line 58. One end of line 58 is attached to the distal end of fixed arm 40 by conventional means, such as an eyebolt as shown. Line 58 extends from arm 40 and through an aperture 60 provided near the distal end of pivotal arm 42. A suitable connector 62 is provided at the end of line 58 for releasably connecting tennis ball 18 thereto. In accordance with the preferred construction of the invention, connector 62 comprises a section of hook and loop fastener material such as that sold under the name VELCRO. Other forms of releasable connecting means may also be suitable for use with training device 10.

From the foregoing, it will be apparent that the present invention comprises an improved tennis training device having several advantages over the prior art. A tennis ball is releasably suspended at an adjustable height to facilitate practice of various strokes. The training device herein is rugged and uncomplicated in construction, portable, manually operated, and can be utilized with any suitable stand or post. Other advantages will readily be apparent to those skilled in the art.

Although particular embodiments of the invention have been illustrated in the Drawings and described in the Detailed Description, it will be understood that the invention is not limited to the embodiments disclosed, but is intended to embrace any alternatives, modifications, and rearrangements and/or substitutions of elements as fall within the scope of the invention.

What is claimed is:

1. A tennis training apparatus, which comprises:
frame means;
a first arm fixedly secured to said frame means and extending outwardly therefrom;
a second arm pivotally secured to said frame means beneath said first arm;
said frame means comprising:
a pair of blocks located in spaced apart relationship;
said first and second arms being secured to one of said blocks; and
a pair of side members rigidly interconnecting said blocks in spaced relationship;
means for selectively effecting manual pivotal movement of said second arm relative to said first arm;
a flexible line of predetermined length extending downwardly from said second arm; and
means located at an end of said first line for releasably connecting a tennis ball thereto.

2. A tennis training apparatus, which comprises:
frame means;
a first arm fixedly secured to said frame means and extending outwardly therefrom;
a second arm pivotally secured to said frame means beneath said first arm;
means for selectively effecting manual pivotal movement of said second arm relative to said first arm;
a first flexible line of predetermined length extending downwardly from said second arm;
said means for selectively effecting pivotal movement of said second arm comprising:
roller means secured to said first arm;
a second flexible line connected at one end to said second arm and extending over said roller means; and
means for releasably securing the other end of said second flexible line to said frame means; and
means located at the end of said first line for releasably connecting a tennis ball thereto.

3. For use in combination with a stand having an upright member, a tennis training device comprising:
frame means mounted for vertical movement along the stand;
means for adjustably securing said frame means to the stand in selective positions therealong;
a first arm fixedly secured to said frame means and extending outwardly therefrom;
a second arm pivotally secured to said frame means beneath said first arm;
said frame means comprising:
a pair of blocks located in spaced apart relationship;
said first and second arms both being secured to one of said blocks; and
a pair of side members rigidly interconnecting said blocks in spaced relationship;
means for selectively effecting pivotal movement of said second arm relative to said first arm;
a first flexible line secured at one end to said first arm and extending downwardly from said second arm through a guide opening formed therein; and
means located at the other end of said first line for releasably connecting a tennis ball thereto.

4. For use in combination with a stand having an upright member, a tennis training device comprising:
frame means mounted for vertical movement along the stand;
means for adjustably securing said frame means to the stand in selective positions therealong;
a first arm fixedly secured to said frame means and extending outwardly therefrom;
a second arm pivotally secured to said frame means beneath said first arm;
means for selectively effecting manual pivotal movement of said second arm relative to said first arm;

a first flexible line secured at one end to said first arm and extending downwardly from said second arm through a guide opening formed therein; and said means for selectively effecting pivotal movement of said second arm comprising:

roller means secured to said first arm;

a second flexible line connected at one of its ends to said second arm and extending over said roller means; and means for releasably securing the other end of said second flexible line to said frame means;

means located at the other end of said first line for releasably connecting a tennis ball thereto.

* * * * *

UNITED STATES PATENT AND TRADEMARK OFFICE

CERTIFICATE OF CORRECTION

PATENT NO. : 4,269,410

DATED : May 26, 1981

INVENTOR(S) : James H. Martin

It is certified that error appears in the above—identified patent and that said Letters Patent is hereby corrected as shown below:

Column 1, line 44, change "has thus arisen" to --thus exists--.
Column 2, line 29, after "designate" delete "like or";
line 38, change "a" to --the--;
line 48, change "by" to --with--.
Column 3, line 21, change "therefrom" to --from the block--;
line 24, change "arrows" to --arrow--;
line 30, after "be" insert --selectively--;
line 41, change "such as" to --like--;
line 48, change "is" to --can be--.
Column 4, line 11, after "said" delete "first".

Signed and Sealed this

*Twentieth* Day of *October 1981*

[SEAL]

*Attest:*

GERALD J. MOSSINGHOFF

*Attesting Officer*

*Commissioner of Patents and Trademarks*